United States Patent [19]

Cronin

[11] 4,444,103

[45] Apr. 24, 1984

[54] BELT-TYPE PRINTING MACHINE

[75] Inventor: Francis S. Cronin, Sunderland, England

[73] Assignee: Edward Thompson (International) Limited, Sunderland, England

[21] Appl. No.: 427,538

[22] Filed: Sep. 29, 1982

[30] Foreign Application Priority Data

Oct. 7, 1981 [GB] United Kingdom ..... 8130333

[51] Int. Cl.[3] ..... B41J 1/18

[52] U.S. Cl. ..... 101/93.13; 101/72

[58] Field of Search ..... 101/93.13, 72, 76, 181, 101/93.14, 45

[56] References Cited

U.S. PATENT DOCUMENTS

| | | | |
|---|---|---|---|
| 677,739 | 7/1901 | Firm | 101/221 |
| 3,408,930 | 11/1968 | Chamness et al. | 101/93.14 |
| 3,457,855 | 7/1969 | Falchero | 101/93.14 |
| 3,665,850 | 5/1972 | Berger et al. | 101/93.13 |
| 3,859,914 | 1/1975 | Strickland | 101/76 |
| 3,998,446 | 12/1976 | Dent | 101/72 |
| 4,084,501 | 4/1978 | Kerwin et al. | 101/76 |
| 4,287,824 | 9/1981 | Boyle | 101/45 |

FOREIGN PATENT DOCUMENTS

| | | | |
|---|---|---|---|
| 1047210 | 1/1979 | Canada | 101/181 |
| 1204239 | 11/1965 | Fed. Rep. of Germany . | |
| 2058453 | 5/1972 | France . | |
| 1296247 | 11/1972 | United Kingdom . | |

*Primary Examiner*—E. H. Eickholt

*Attorney, Agent, or Firm*—Cushman, Darby & Cushman

[57] ABSTRACT

A belt-type printing machine, primarily for printing large numbers of different bingo tickets, includes a pair of endless belts one of which is slightly longer than the other. The belts each carry a series of identically-sized printing plates there being more plates on the longer belt. The plates on one belt are used to print a first sub-area of each ticket, while the plates on the other belt are used to print the remaining sub-area of each ticket, the different lengths of the belts, which are rotated at the same speed, resulting in the printing of tickets with different combinations of sub-areas from the plates.

6 Claims, 3 Drawing Figures

BELT-TYPE PRINTING MACHINE

BACKGROUND OF THE INVENTION

This invention relates to belt-type printing machines in which endless belts carry ordered sequences of printing plates for printing series of impressions in proper sequences on webs of sheet material such as paper.

Such machines are now well-established for effecting, for example, continuous printing of the individual pages of books, brochures and similar articles, said machines typically incorporating a pair of printing mechanisms each including an endless printing belt. Printing plates corresponding to the even-numbered pages of a book, brochure or the like to be printed are accurately located around one of said belts, while printing plates corresponding to the odd-numbered pages to be printed are accurately located around the other belt. The two belts are of identical length and are driven at the same speed, which speed is related to that of the web of sheet material, such that double-sided sheets to comprise the individual pages of the books, brochures or the like are accurately printed by the machine.

Such machines have proved extremely efficient in the production of printed articles comprising of the order of up to a few hundred individual pages.

When printing, for example, bingo tickets, it is often necessary to produce millions of such tickets all of which must be different. Even using the largest of the available belt-type printing machines, the time and cost involved is substantial. Further the initial artwork associated with the preparation of the individual millions of tickets involves extremely high costs.

SUMMARY OF THE INVENTION

According to the present invention there is provided a belt-type printing machine for printing a plurality of printed sheets, the machine comprising two or more endless belts each carrying thereon an ordered sequence of printing plates of the same dimensions, each plate on the first belt being associated with the printing of a first sub-area of a sheet and each plate on the or each further belt being associated with the printing of a further sub-area of a sheet, the first and further belts being of different lengths whereby the belts carry different numbers of printing plates, the arrangement being such that, on controlled passage of a series of sheets past each endless belt in turn and on rotation of said belts to move the printing plates thereon at the same speeds, first and further sub-areas of each sheet are sequentially printed by the first and further belts respectively to produce a series of printed sheets each comprising a combination of sub-areas printed from printing areas on different belts, each rotation of a belt displacing the printing plates thereon relative to the plates on the or each further belt whereby, on continuous rotation of the belts, a plurality of printed sheets each with different combinations of sub-areas thereon are printed.

Although such a machine has applications in many different fields where a series of different printed sheets are required, it is particularly useful in the high-speed printing of large numbers of different bingo tickets.

Conveniently each belt carries a series of rows of printing plates across its width, each row containing a number of printing plates, said series extending around the circumference of the belt to define a number of columns of printing plates around said belt.

In a currently preferred bingo ticket printing machine, there are two endless belts, each row on each belt containing eight printing plates, there being 600 rows on one belt and 601 rows on the other belt, the one belt being shorter than the other belt by the depth of one ticket, typically $1\frac{3}{4}$ inches. The plates on one belt may be associated with the printing of five of the vertical columns of a typical bingo ticket, for example the outer five columns, and the plates on the other belt may be associated with the printing of the other five vertical columns, for example the inner five columns.

It will be appreciated that continuous rotation of the belts of such a machine for a full run of the machine enables the printing of 2,884,800 different tickets without altering the positions of the printing plates on the belt, while a total of 23,078,400 different tickets can be printed from the original 9,608 plates by sequentially moving the eight columns of plates on a belt one step sideways after each run.

DESCRIPTION OF THE PREFERRED EMBODIMENT

Figure 1:
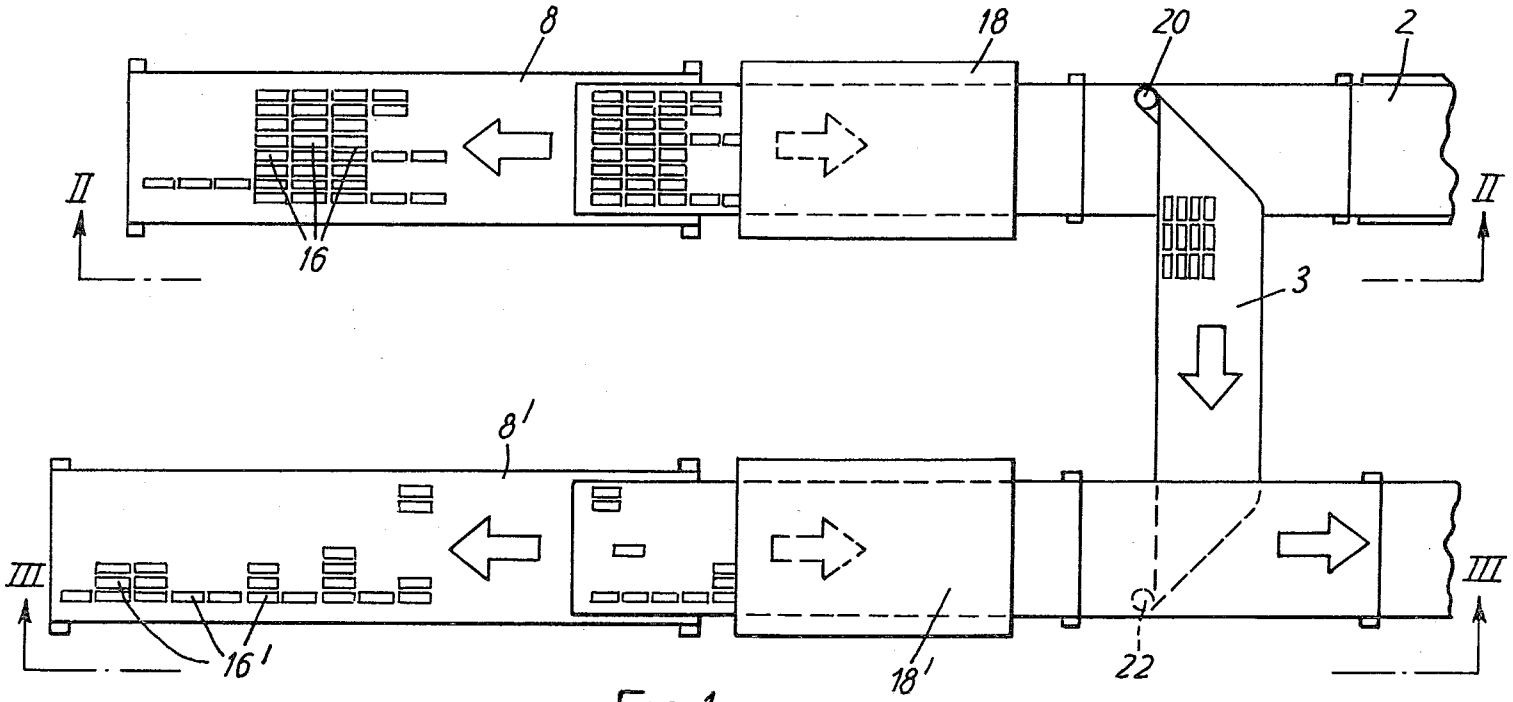
FIG. 1 is a plan view from above of a printing machine according to the invention.
Figure 2:
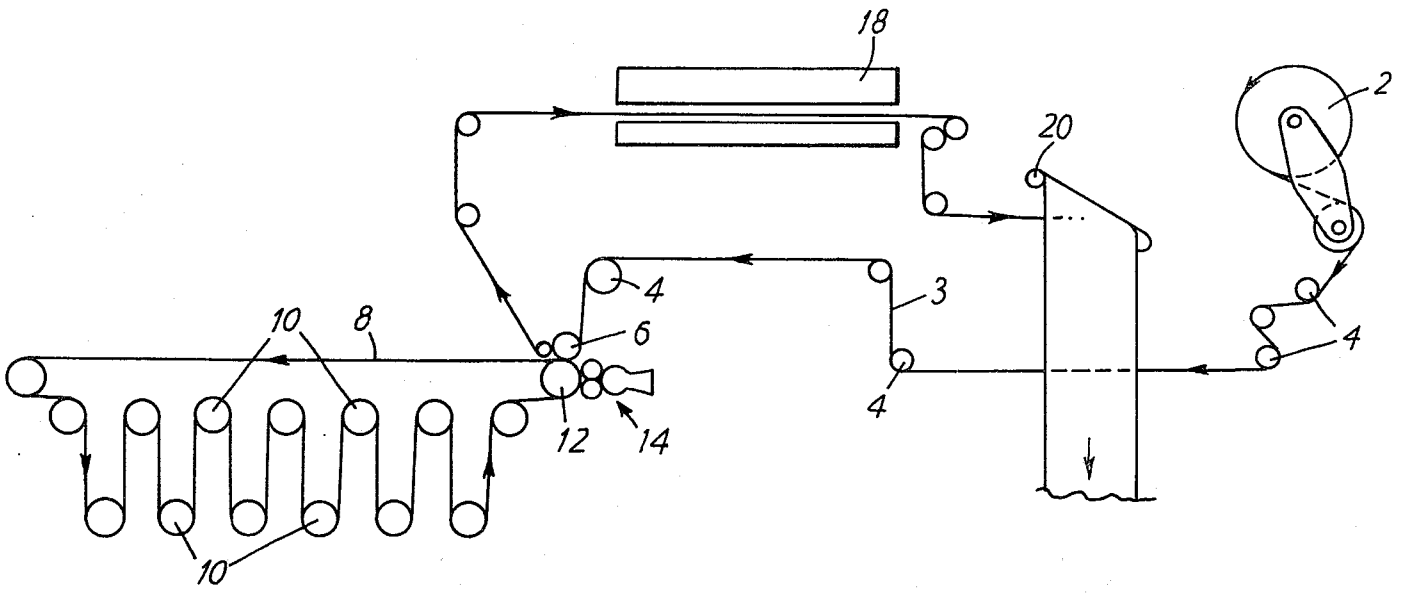
FIGS. 2 and 3 are side views in the directions of arrows II—II and III—III in FIG. 1 respectively.
Figure 3:
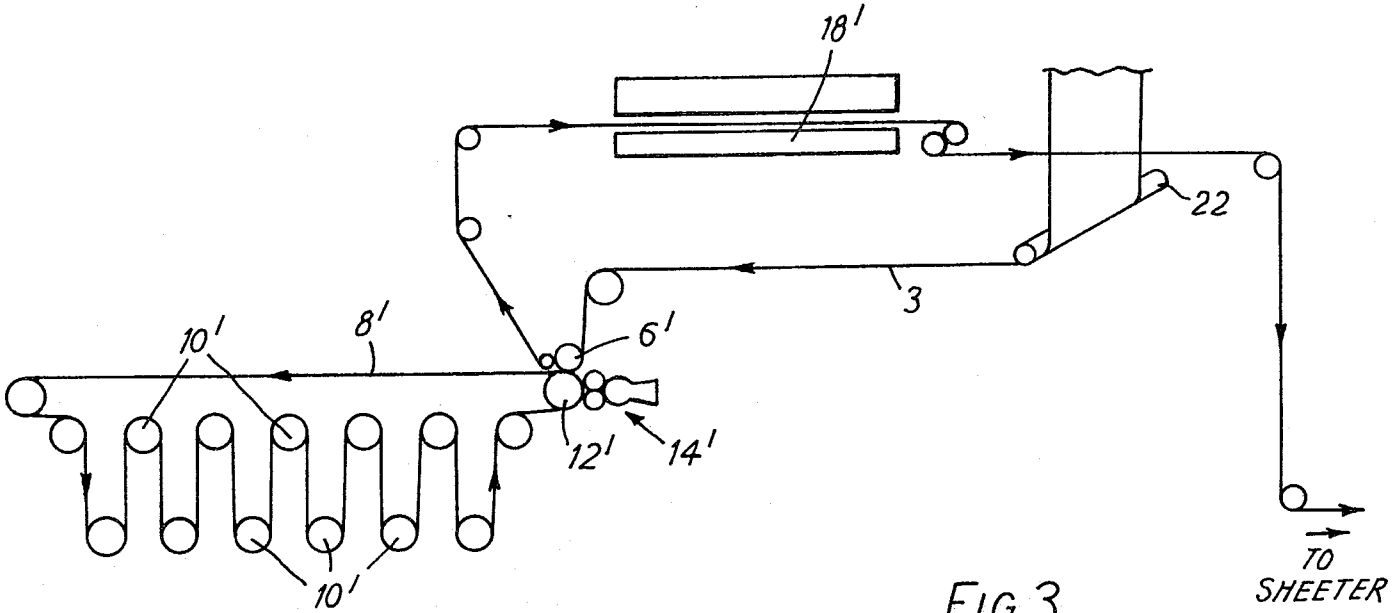

Referring to the drawings there is illustrated a machine for printing bingo tickets which includes a roll 2 of paper, the paper from which is fed as a web 3 along a path defined by a plurality of rollers such as 4 and over an impression cylinder 6 forming part of a first printing mechanism.

Said first printing mechanism further includes an endless belt 8 mounted for continuous movement over a series of festooned idler rollers 10 and over a plate cylinder 12. The plate cylinder 12 carries at its ends a pair of sprocket wheels (not shown) for engagement in perforations (not shown) formed along the side edges of the belt 8 to effect drive of said belt.

An inker arrangement 14 is located immediately adjacent the plate cylinder 12 and just in front of the nip defined by the cylinders 6 and 12 between which the web 3 of paper is fed.

A series of flexible printing plates 16 are attached to the outer surface of the belt 8 and it will be appreciated that, on operation of the machine, the plates 16 are inked by the arrangement 14 and web 3 is printed on passage between the plate cylinder 12 and the impression cylinder 6. The web is then passed through a dryer 18, over a pair of turning bars 20,22, which serve to turn the web 3 through 180°, and is thence fed to a further printing mechanism similar in construction to that described above and in which components equivalent to those of the mechanism so far described are similarly referenced but with a dash added thereto. After passage through the dryer 18', the web 3 of printed paper is fed to an automatic sheeter.

The basic construction of the machine so far described is of relatively conventional form, although it will be appreciated that the festooned nature of the rollers 10,10' supporting the belts 8,8' enable a relatively long belt to be accommodated in a relatively compact space, while the web 3 of paper is not turned over in its passage between the two printing mechanisms. The inventive differences of the illustrated machine over the prior art will now be detailed.

The printing plates 16,16' are all of the same size, equivalent to that of a standard bingo ticket, and typically each comprise a 30 thou thick photopolymer plate fixed by 4 thou thick double-sided adhesive tape to the belts 8,8', which belts may be 10 thou thick polyethylene terephthalate.

There are eight columns of plates across each belt, belt 8 being of a length to accommodate exactly 600 rows of plates 16 around its circumference and belt 8' being slightly longer to accommodate 601 rows of plates 16' thereon. Thus belt 8' is longer than belt 8 by the depth of a plate—i.e. $1\frac{3}{4}$ inches.

The plates 16 on belt 8, which are all different, are each associated with the printing of a first sub-area of bingo tickets, said sub-area conveniently comprising the first three vertical columns and the last two vertical columns of the tickets. The plates 16' on belt 8', which are again all different, are associated with the printing of the remaining sub-area of the tickets—i.e. the intermediate five vertical columns of the tickets. It will of course be appreciated that the sub-areas printed by the plates 16 and 16' can be other than as detailed above and can be chosen to suit particular requirements.

On operation of the machine, the belts, 8,8' and the web 3 of paper are moved at accurately controlled speeds carefully related to one another and in such a manner that the web 3 first of all passes between the cylinders 6,12 whereby an ordered sequence of first sub-areas of the eventual bingo tickets are accurately printed thereon by the plates 16. The arrows on the belts 8,8' in FIG. 1 indicate the direction of movement of said belts, while the other arrows (both in full outline and in dotted outline where the web 3 is hidden from view) indicate the direction of movement of the web 3.

The web 3 is then fed between the rollers 6',12' whereby the remaining sub-areas of the tickets are printed by the plates 16'. The feed of the web 3 and the speed of rotation of the belts 8,8' are such that the printed first sub-areas of the tickets are accurately aligned with associated printing plates 16' on passage between the rollers 6',12'.

The belts 8,8' are rotated such that the speeds of movement of the plates 16,16' thereon are identical, and it will thus be appreciated that, after one complete revolution of the belt 8 to print 4,800 first sub-areas, there is still one row of printing plates 16' on the belt 8' that has not been used to print remaining sub-areas. Continuous rotation of the belts 8,8' results in this last row of plates 16' printing remaining sub-areas which are combined with first sub-areas printed by the first row of plates 16 on the belt 8. Thus, on every rotation of the belt 8, the rows of printing plates 16' on the belt 8' are displaced by one row relative to the rows of printing plates 16 on the belt 8. In this way 2,884,800 different combinations of first and remaining sub-areas can be printed without moving the plates 16 or 16' on the belts 8,8'.

Moving the eight columns of printing plates 16,16' on the belts 8,8' relative to one another after each complete cycle of the machine enables 23,078,400 different tickets to be printed from the basic 9,608 printing plates.

Bingo tickets are typically $1\frac{3}{4}$ inches deep and belt 8 is therefore 1050 inches long, while belt 8' is $1051\frac{3}{4}$ inches long. The belts 8,8' are driven at typically 1000 feet per minute, resulting in in excess of eleven complete revolutions of the belts per minute. At such rates, in excess of 23,000,000 tickets can be printed in about 7 hours of working time of the machine, such vast numbers being achieved from as few as 9,608 printing plates the cost of the art-work for which is minimal.

Although described in relation to the production of bingo tickets, it is to be emphasised that the basic machine of the invention—a multiple belt printing press with different length belts—has many other applications and may incorporate more than two belts if desired. Further, the numbers of printing plates 16,16' per belt 8,8' quoted above are by way of example only and can be varied to suit particular requirements.

What I claim and desire to secure by Letters Patent is:

1. A belt-type printing machine for printing a plurality of printed sheets, the machine comprising at least two endless belts, and an ordered sequence of printing plates of the same dimensions carried on each of said belts, each plate on a first belt being associated with the printing of a first sub-area of a sheet and each plate on the at least one further belt being associated with the printing of a further sub-area of the sheet, the first and further belts being of different lengths whereby said belts carry different numbers of printing plates thereon, the arrangement being such that, on controlled passage of a series of sheets past each endless belt in turn and on rotation of said belts to move the printing plates thereon at the same speeds, first and further sub-areas of each sheet are sequentially printed by the first and further belts respectively to produce a series of printed sheets each comprising a combination of sub-areas printed from printing areas on different belts, each rotation of a belt displacing the printing plates thereon relative to the plates on the at least one further belt whereby, on continuous rotation of the belts, a plurality of printed sheets each with different combinations of sub-areas thereon are printed.

2. A printing machine as claimed in claim 1 in which each belt carries a series of rows of printing plates across its width, each row containing a number of printing plates, said series extending around the circumference of the belt to define a number of columns of printing plates around said belt.

3. A printing machine as claimed in claim 2 in which there are two endless belts, each row on each belt containing eight printing plates, there being 600 rows on one belt and 601 rows on the other belt, the one belt being shorter than the other belt by the depth of one plate.

4. A printing machine as claimed in claim 3 for printing a plurality of bingo tickets, the plates on one belt being associated with the printing of five of the vertical columns of the bingo tickets and the plates on the other belt being associated with the printing of the other five vertical columns of said bingo tickets.

5. A printing machine as claimed in claim 4 in which the plates on the one belt are associated with the printing of the outer two columns to one side and the outer three columns to the other side of the bingo tickets, and the plates on the other belt are associated with the printing of the remaining intermediate five columns of said bingo tickets.

6. A printing machine as claimed in claim 1 in which each belt passes over a series of festooned guide rollers.

* * * * *